US008007131B2

(12) United States Patent
Liu et al.

(10) Patent No.: US 8,007,131 B2
(45) Date of Patent: Aug. 30, 2011

(54) LED LAMP HAVING ENHANCED WATERPROOFING

(75) Inventors: Jun Liu, Shenzhen (CN); Yong-Dong Chen, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 404 days.

(21) Appl. No.: 12/396,474

(22) Filed: Mar. 3, 2009

(65) Prior Publication Data

US 2009/0310363 A1 Dec. 17, 2009

(30) Foreign Application Priority Data

Jun. 13, 2008 (CN) ..... 2008 1 0067735

(51) Int. Cl.
*F21V 29/00* (2006.01)
*F21V 31/00* (2006.01)

(52) U.S. Cl. ..... 362/267; 362/249.02; 362/294

(58) Field of Classification Search ..... 362/267, 362/218, 217.1, 249.02, 294
See application file for complete search history.

(56) References Cited

U.S. PATENT DOCUMENTS

2008/0253127 A1* 10/2008 Willwohl et al. ..... 362/294
2009/0180281 A1* 7/2009 Ahland et al. ..... 362/234
2009/0296416 A1* 12/2009 Luo et al. ..... 362/487

* cited by examiner

*Primary Examiner* — David V Bruce
(74) *Attorney, Agent, or Firm* — Altis Law Group, Inc.

(57) ABSTRACT

An LED lamp includes a heat sink, a plurality of LED modules attached to the heat sink, and an envelope disposed on the base of the heat sink. The heat sink includes a base and a plurality of fins extending from the base. The envelope defines a receiving groove therein surrounding the LED modules. The receiving groove is stepped to have an upper portion and a lower portion recessed downwardly from a bottom of the upper portion. The LED lamp further includes an annular waterproof gasket. The waterproof gasket includes a main body received in the upper portion of the receiving groove and an engaging portion protruding downwardly from a bottom thereof and engagingly received in the lower portion of the receiving groove. The lower portion and the upper portion of the receiving groove are both rectangular in cross-section.

14 Claims, 7 Drawing Sheets

LED LAMP HAVING ENHANCED WATERPROOFING

BACKGROUND OF THE INVENTION

1. Field of the Invention

The present disclosure relates to LED (light emitting diode) lamps, and more particularly to an LED lamp having enhanced waterproofing.

2. Description of Related Art

LEDs are well known solid state light sources, in which current in a forward direction at a junction comprising two different semiconductors, electrons and cavities generate light. LEDs provide advantages of resistance to shock and practically limitless lifetime under specific conditions. When deployed in a lamp, LEDs offer a cost-effective yet high quality alternative to incandescent and fluorescent fixtures.

An LED lamp generally requires a plurality of LEDs, most driven at the same time, which results in a rapid rise in operating temperature. Generally, since the lamps lack effective heat dissipation capability, operation can cause instability. Consequently, the LED lamp usually comprises a heat sink contacting the LEDs to dissipate the heat generated thereby.

When the LED lamp is used outdoors for illumination, airborne detritus and moisture may enter the LED lamp, causing current leakage or short circuit, or other contamination of the LEDs. A conventional waterproof structure of an LED lamp includes a waterproof gasket and a groove defined in an envelope which correspondingly covers the LEDs. The envelope is disposed on the heat sink. The waterproof gasket received in the groove is sandwiched between the envelope and the heat sink. However, this structure requires compression of the waterproof gasket by the heat sink to expand in the groove, whereby the waterproof gasket intimately contacts the heat sink and the groove. When compression force on the gasket is excessive, damage to the groove, the waterproof gasket or other portions of the envelope can result.

What is needed, therefore, is an LED lamp which has enhanced waterproofing addressing the described limitations.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
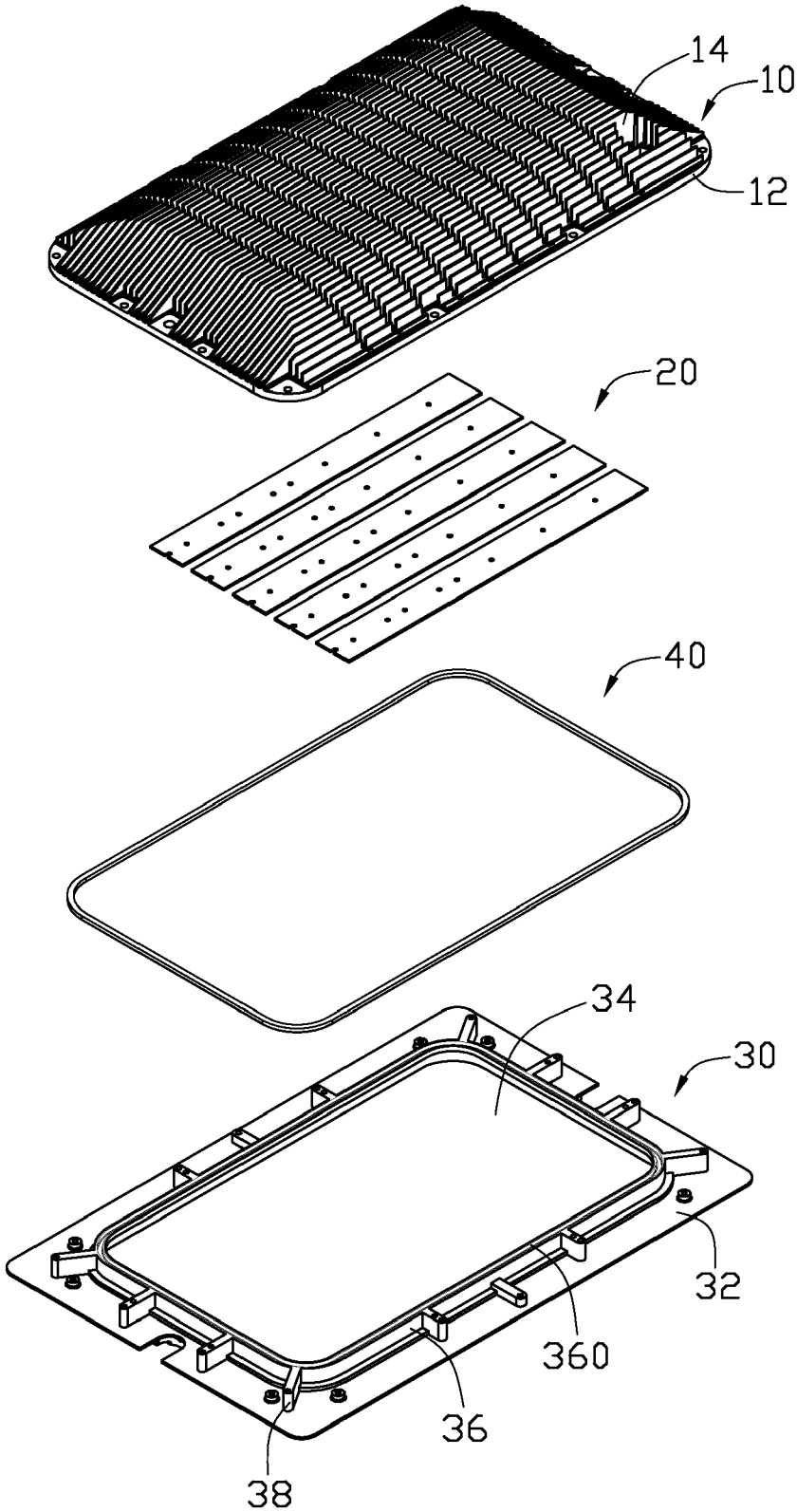
FIG. 1 is an isometric, exploded view of an LED lamp in accordance with an exemplary embodiment of the disclosure.
Figure 2:
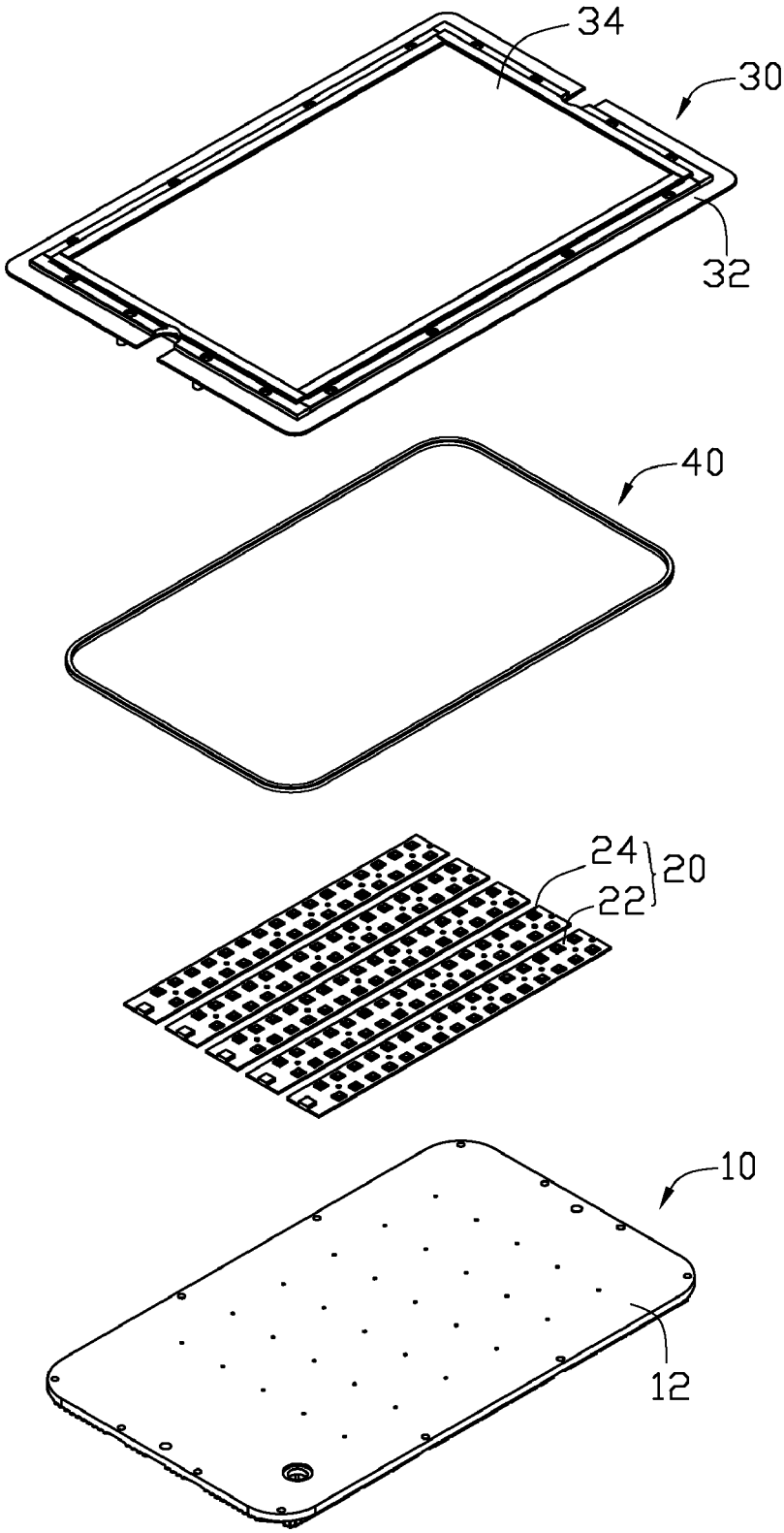
FIG. 2 is an inverted view of the LED lamp of FIG. 1.

Referring to FIGS. 1 and 2, an LED lamp in accordance with an exemplary embodiment of the disclosure includes a heat sink 10, a plurality of LED modules 20 thermally attached to the heat sink 10, an envelope 30 covering the LED modules 20 and a waterproof gasket 40 engaging the envelope 30 and sandwiched between the envelope 40 and the heat sink 10.

The heat sink 10 is metal with good heat conductivity, such as copper or aluminum, and comprises a substantially rectangular base 12 and a plurality of fins 14 extending upwardly from a top surface of the base 12. The fins 14 are perpendicular to the top surface of the base 12 and spaced from each other.

Each of the LED modules 20 comprises an elongated printed circuit board 22 with a plurality of spaced LEDs 24 evenly mounted along a length of a bottom side thereof.

Figure 3:
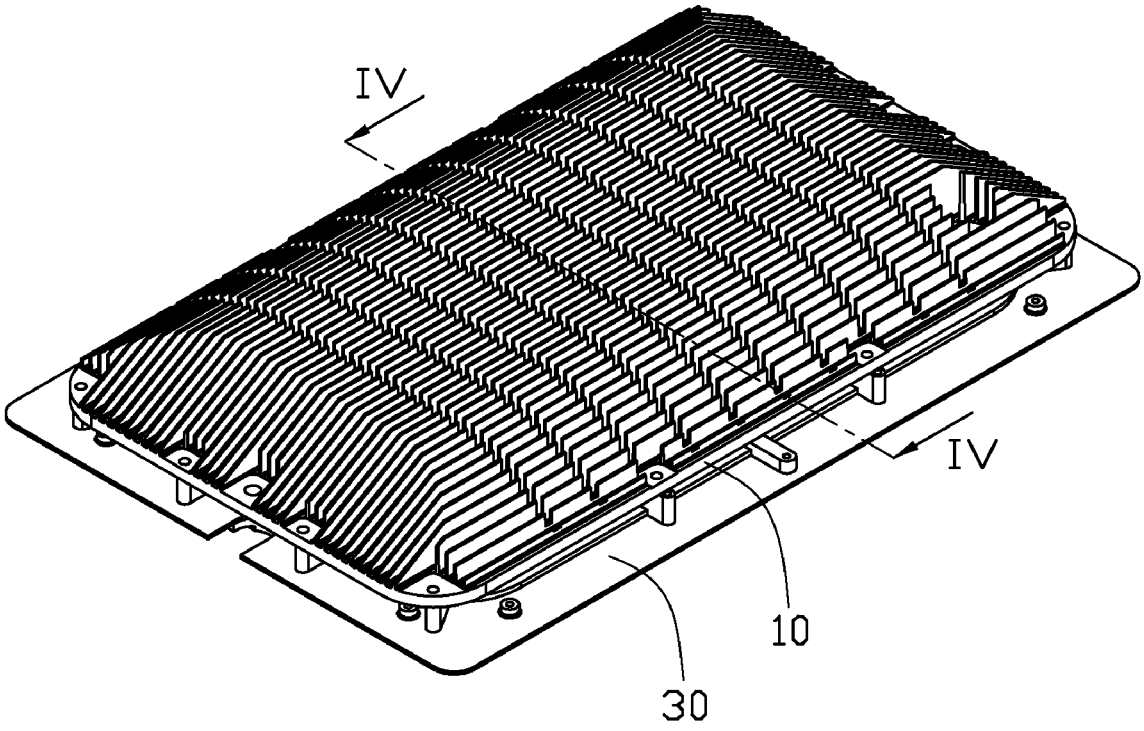
FIG. 3 is an assembled view of the LED lamp of FIG. 1.
Figure 4:
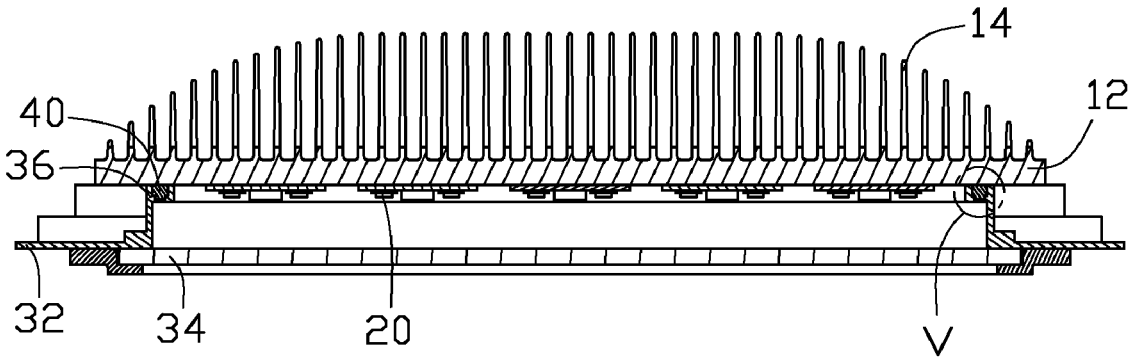
FIG. 4 is a cross-section of the LED lamp of FIG. 3, taken along a line IV-IV thereof.
Figure 5:
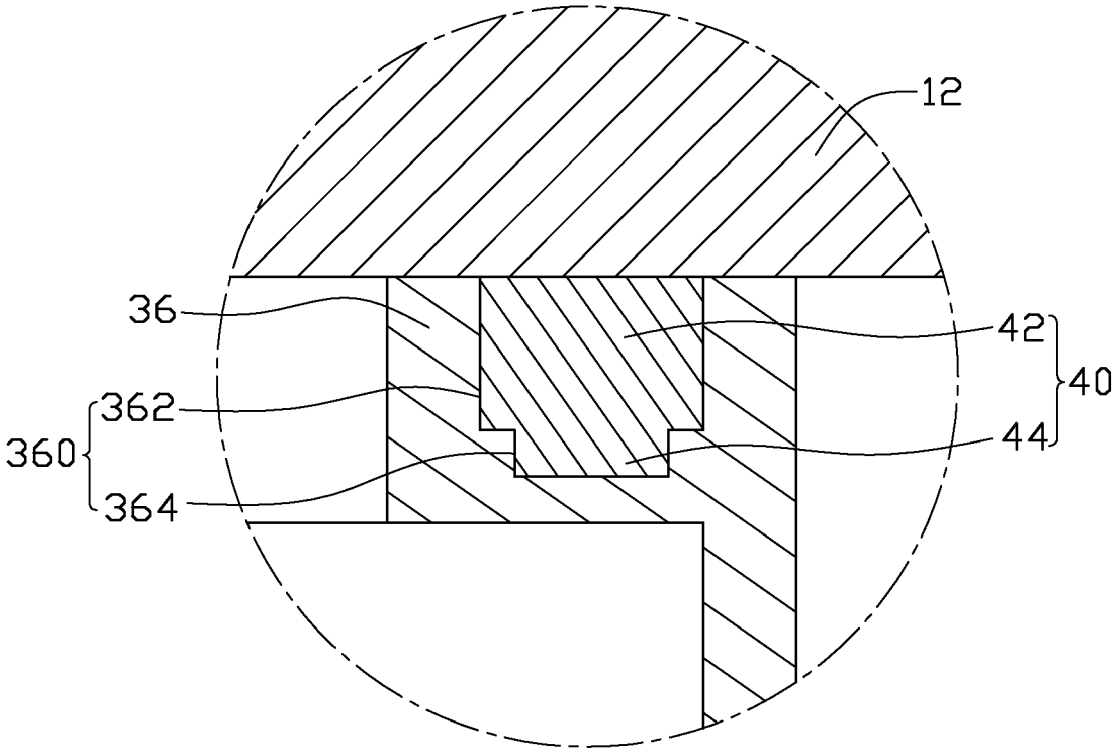
FIG. 5 is an enlarged view of a part V of the LED lamp of FIG. 4.

Also referring to FIGS. 3-5, the envelope 30 comprises a rectangular annular frame 32 and a corresponding rectangular lens 34 at a central portion of the frame 32. The envelope 30 is disposed on a circumference of a bottom surface of the base 12. The lens 34 is transparent material such as glass or plastic, and correspondingly located below the LED modules 20. An annular protruding portion 36 extends upwardly from a top surface of the frame 32 and surrounds the lens 34. An annular receiving groove 360 is defined in a top surface of the protruding portion 36. The receiving groove 360 is stepped to have an upper portion 362 and a lower portion 364 recessed downwardly from a central portion of a bottom of the upper portion 362 and in communication with the upper portion 362, and two steps (not labeled) are formed between the upper portion 362 and the lower portion 364. The upper portion 362 and the lower portion 364 both have rectangular cross-sections. The cross-section of the lower portion 364 is smaller than that of the upper portion 362. A plurality of spaced protruding arms 38 extends outwardly from an outer circumferential periphery of the protruding portion 36. A top surface of the protruding portion 36 is coplanar with those of the protruding arms 38, providing intimate contact with the bottom surface of the base 12.

The waterproof gasket 40 is a rectangular ring including an annular main body 42 and an engaging portion 44 protruding downwardly from a central portion thereof. The main body 42 has a rectangular cross-section identical to that of the upper portion 362 of the receiving groove 360. The engaging portion 44 has a rectangular cross-section identical to that of the lower portion 364 of the receiving groove 360. The waterproof gasket 40 is slightly larger than the receiving groove 360, whereby the waterproof gasket 40 is compressed by the base 12 of the heat sink 10 and received in the receiving groove 360 of the envelope 30.

Figure 6:
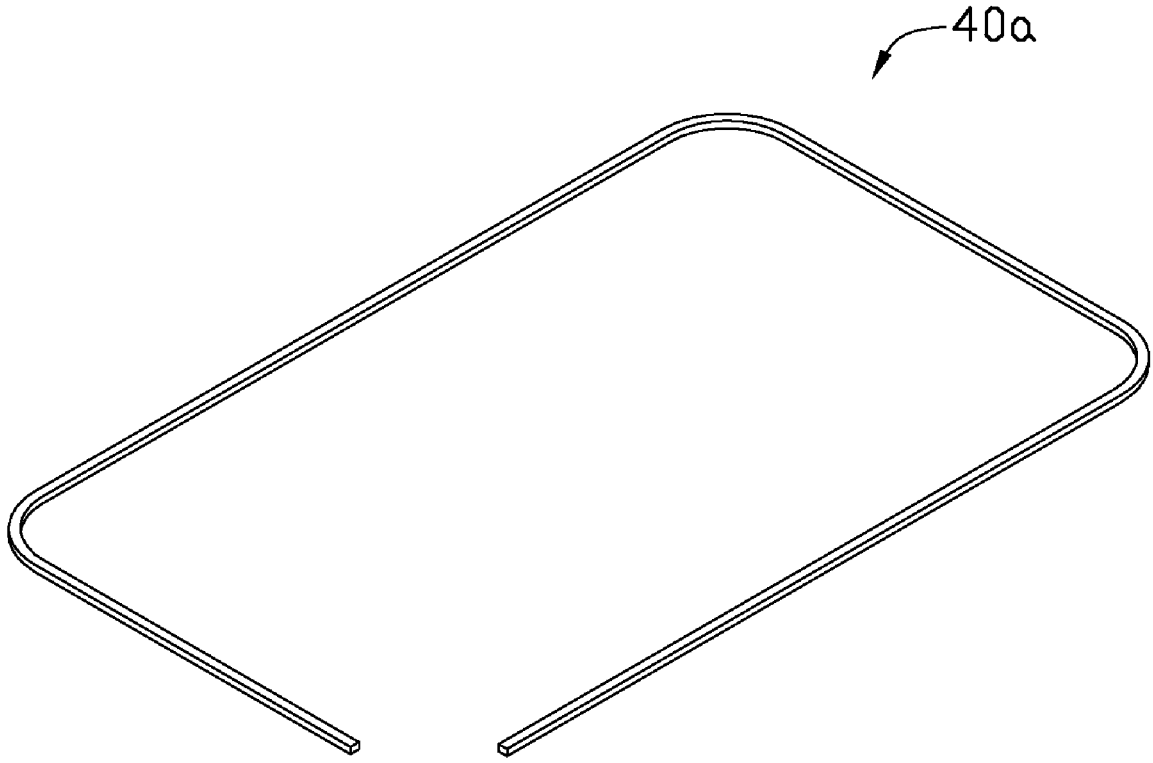
FIG. 6 is an isometric view of an alternative waterproof gasket with a corner removed for clarity.
Figure 7:
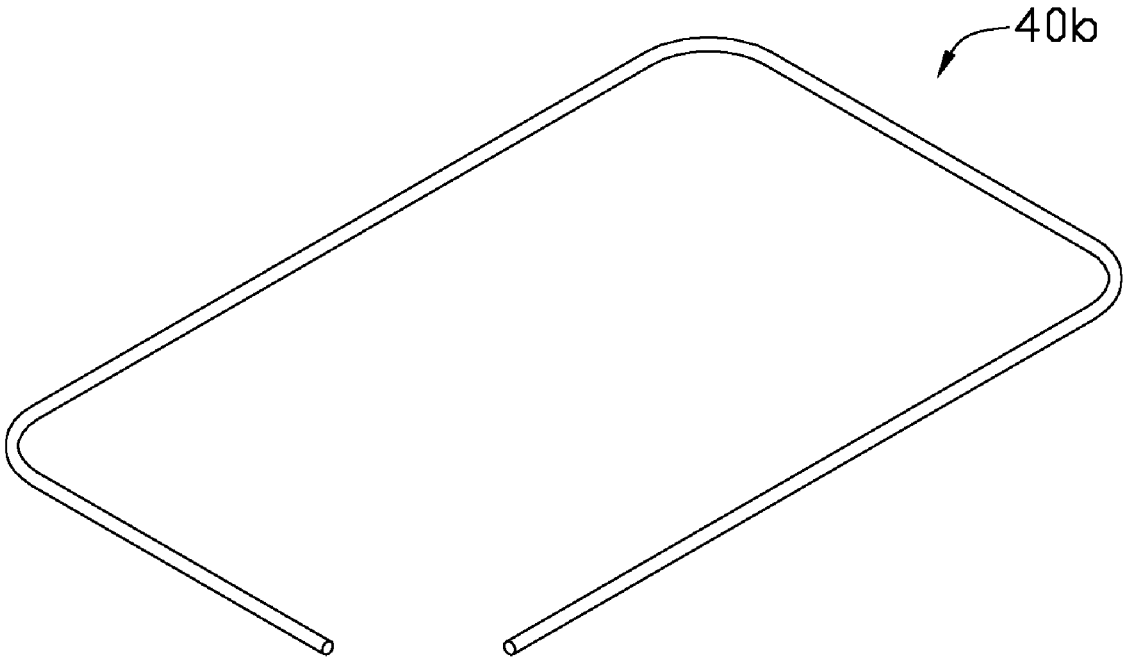
FIG. 7 is an isometric view of a further alternative waterproof gasket with a corner removed for clarity.

The waterproof gasket 40 is not limited to the configuration described, and can, alternatively, referring to FIG. 6, be configured as a waterproof gasket **40*a* having a rectangular cross-section as illustrated. Referring to FIG. 7, a waterproof gasket 40*b*** having a round cross-section is illustrated.

FIGS. 3-5 illustrate assembly of the LED lamp with the waterproof gasket 40. The LED modules 20 are attached to the bottom surface of the base 12 of the heat sink 10 with the printed circuit board 22 thermally contacting the bottom surface of the base 12. The waterproof gasket 40 is received in the receiving groove 360 in the protruding portion 36 of the envelope 30. The base 12 is positioned on the envelope 30 with the LED modules 20 corresponding to the lens 34 of the envelope 30 and surrounded by the waterproof gasket 40. The bottom surface of the base 12 and the protruding arms 38 of the envelope 30 are fastened together by fasteners such as screws (not shown) which extend through holes (not labeled) in a periphery of the base 12 of the heat sink 10 and screw into threaded holes (not labeled) in the protruding arms 38. The waterproof gasket 40 is compressed by the base 12 to have the engaging portion 44 engaged in the lower portion 364 of the receiving groove 360 and the main body 42 engaged in the upper portion 362 of the receiving groove 360. By this manner, the waterproof gasket 40 is fitly and waterproofly sandwiched between the envelope 30 and the bottom surface of the base 12 of the heat sink 10.

When applied in the LED lamp, the waterproof gasket 40*a* or 40*b* received in the receiving groove 360 of the envelope 30 is compressed by the bottom surface of the base 12 of the heat sink 10, experiencing deformation with a bottom thereof compressed into the lower portion 364 of the receiving groove 360. Accordingly, the waterproof gasket 40*a* or 40*b* fills the lower portion 364 and the upper portion of the receiving groove 360, and still comprises the annular main body 42 in the upper portion 362 and the engaging portion 44 in the lower portion 364.

According to the exemplary embodiment of the disclosure, the receiving groove 360 has a lower portion 364 recessed further downwardly from the central portion of the bottom of the upper portion 362, accommodating deformation of the waterproof gasket 40, 40*a*, 40*b* therein. When compressed by the base 12 of the heat sink 10, the waterproof gasket 40, 40*a*, 40*b* deforms and the central portion of the bottom thereof enters the lower portion 364 and the lateral portions beside the central portion remain blocked by the two steps of the receiving groove 360. Thus, the waterproof gasket 40 is firmly and effectively seated between the base 12 of the heat sink 10 and the envelope 30, enhancing waterproof effectiveness of the LED lamp.

It is believed that the present disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a base;

a plurality of LED modules each comprising a printed circuit board thermally attached to a bottom surface of the base of the heat sink and a plurality of LEDs mounted on the printed circuit board;

an envelope disposed on the base of the heat sink, comprising an annular frame, the frame defining a receiving groove surrounding the LED modules, the receiving groove stepped to have an upper portion and a lower portion further recessed downwardly from a bottom of the upper portion; and an annular waterproof gasket received in the receiving groove and sandwiched between the base of the heat sink and the envelope, the waterproof gasket comprising a main body and an engaging portion protruding downwardly from a bottom of the main body;

wherein the main body of the waterproof gasket is received in the upper portion of the receiving groove and the engaging portion of the waterproof gasket is received in the lower portion of the receiving groove.

2. The LED lamp of claim 1, wherein the engaging portion of the waterproof gasket protrudes from a central portion of the bottom of the main body.

3. The LED lamp of claim 1, wherein the engaging portion of the waterproof gasket is identical in cross-section to the lower portion of the receiving groove.

4. The LED lamp of claim 1, wherein the main body of the waterproof gasket is identical in cross-section to the upper portion of the receiving groove.

5. The LED lamp of claim 1, wherein the envelope further comprises a lens located at a central portion of the frame, covering the LED modules and an annular protruding portion extending upwardly from the frame and surrounding the lens.

6. The LED lamp of claim 5, wherein the receiving groove is defined in a top surface of the protruding portion.

7. The LED lamp of claim 6, wherein the top surface of the protruding portion contacts the bottom surface of the base.

8. The LED lamp of claim 1, wherein the lower portion of the receiving groove is recessed from a central portion of the bottom of the upper portion.

9. An LED lamp comprising:

a heat sink comprising a base having a bottom surface and a top surface and a plurality of fins extending from the top surface of the base;

a plurality of LED modules mounted on the bottom surface of the base of the heat sink;

an envelope engaging a circumference of the base, wherein the envelope defines a receiving groove therein surrounding the LED modules, and wherein the receiving groove comprises a first portion and a second portion different from the first portion; and an annular waterproof gasket sandwiched between the base of the heat sink and the envelope, the waterproof gasket comprising a first section received in the first portion of the receiving groove and a second section received in the second portion of the receiving groove.

10. The LED lamp of claim 9, wherein the first portion of the receiving groove is rectangular in cross-section, and the second portion of the receiving groove is rectangular in cross-section thereof.

11. The LED lamp of claim 10, wherein the first section of the waterproof gasket is rectangular in cross-section and the second section of the waterproof gasket is rectangular in cross-section.

12. The LED lamp of claim 10, wherein the cross-section of the second portion of the receiving groove is smaller than that of the first portion of the receiving groove.

13. The LED lamp of claim 9, wherein the envelope comprises a frame, a lens contained in a central area of the frame, an annular protrusion extending upwardly from the frame and surrounding the lens, and the receiving groove is defined at a top of the protrusion of the envelope.

14. The LED lamp of claim 13, wherein the envelope further comprises a plurality of arms extending radially from a circumferential periphery of the protrusion, the arms being secured to the bottom surface of the base of the heat sink.

* * * * *